United States Patent [19]

Kaim

[11] 4,206,849

[45] Jun. 10, 1980

[54] TAIL PORTION FOR RAILROAD CAR COUPLER KNUCKLE

[75] Inventor: John W. Kaim, Chicago, Ill.

[73] Assignee: AMSTED Industries Incorporated, Chicago, Ill.

[21] Appl. No.: 926,449

[22] Filed: Jul. 20, 1978

[51] Int. Cl.[2] ..... B61G 3/06

[52] U.S. Cl. ..... 213/151; 213/109

[58] Field of Search ..... 213/109, 110, 115, 119, 213/122, 125-127, 131, 135-138, 151

[56] References Cited

U.S. PATENT DOCUMENTS

| | | | |
|---|---|---|---|
| 1,080,744 | 12/1913 | Barth et al. | 213/122 |
| 1,932,440 | 10/1933 | Bazeley | 213/127 X |
| 4,090,615 | 5/1978 | Martin | 213/151 |

*Primary Examiner*—Randolph A. Reese

*Attorney, Agent, or Firm*—John L. Schmitt; Fred P. Kostka; Edward J. Brosius

[57] ABSTRACT

A railroad car coupler having a knuckle in an open position further includes a lock which rests on a tail portion of the knuckle. By providing a continuous clearance between a leg portion of the lock and an end wall of the knuckle tail portion, lock drop reliability is increased substantially upon the knuckle being swung from the open position to a closed position.

2 Claims, 7 Drawing Figures

FIG. 3
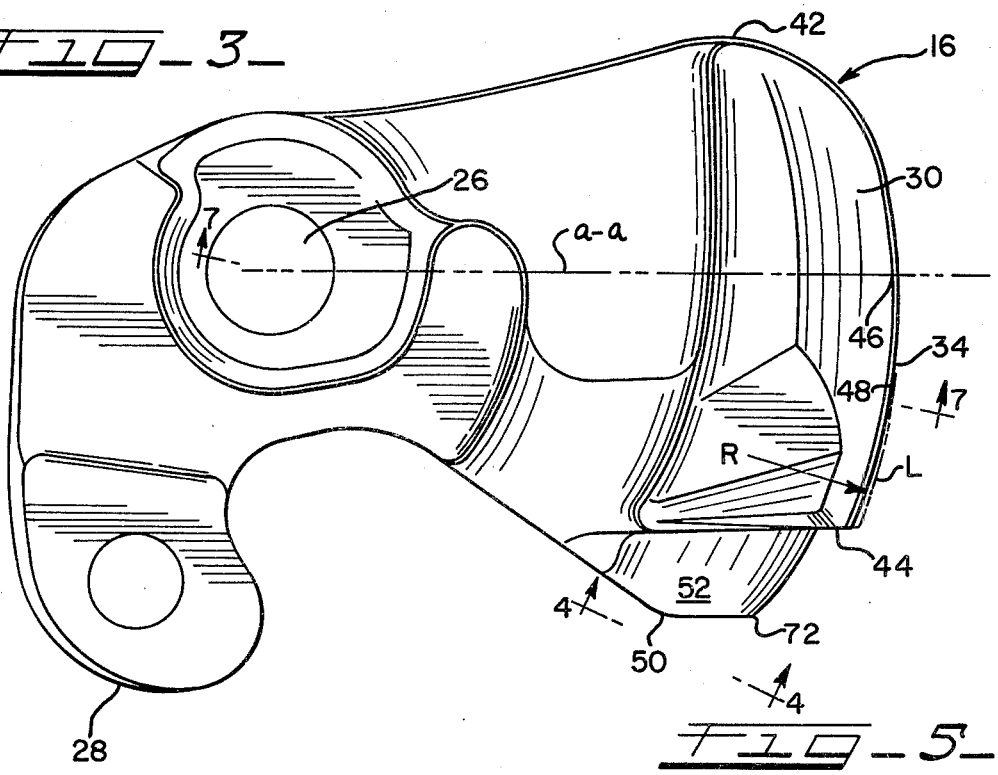
FIG. 5
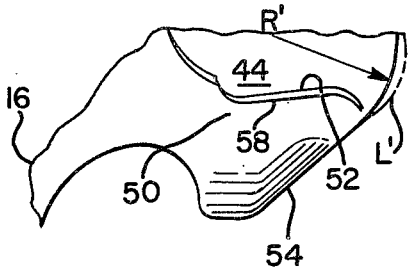
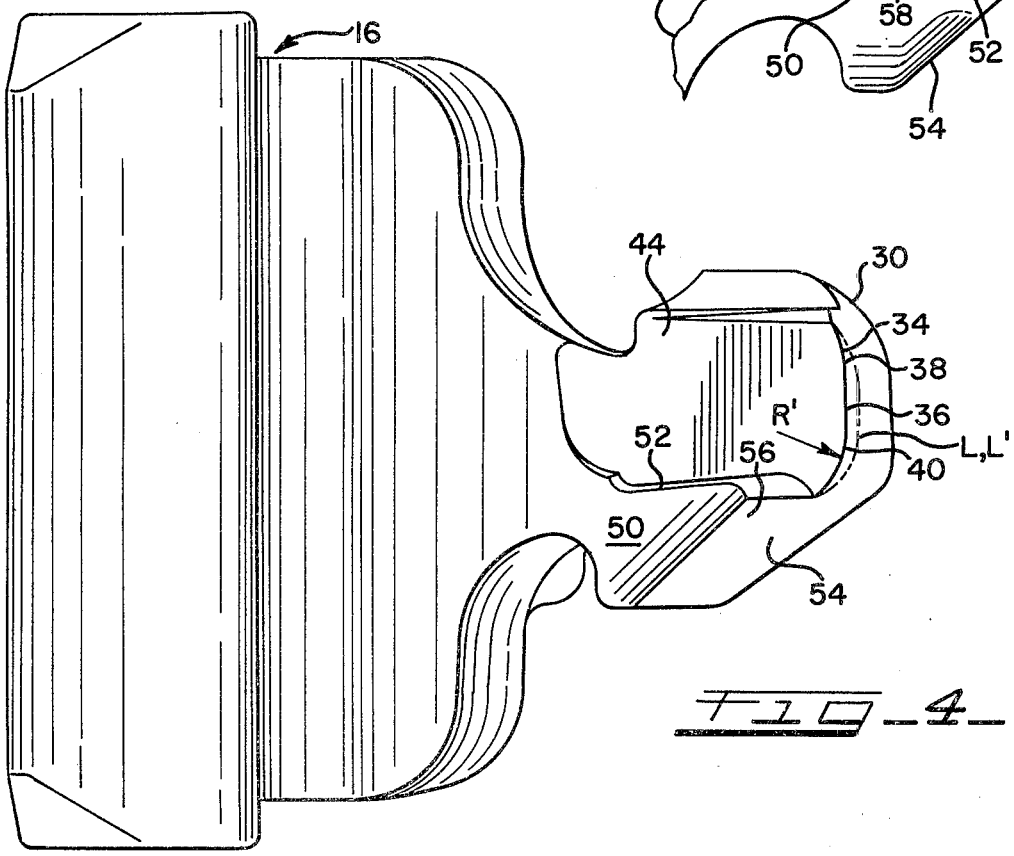
FIG. 4

TAIL PORTION FOR RAILROAD CAR COUPLER KNUCKLE

BACKGROUND OF THE INVENTION

1. Field of the Invention

This invention relates to railroad car couplers. More particularly, this invention relates to a tail portion of a knuckle of the coupler having a configuration which interacts with a lock of the coupler in such a manner that upon the knuckle being swung from an open position to a closed position, the lock drops to prevent the knuckle from opening thereafter.

2. Description of the Prior Art

Standard AAR (Association of American Railroads) Type E couplers comprise a coupler head having therein a vertical lock chamber. Within the chamber is a coupler lock which may be selectively raised from a lower locking position to either one of two raised unlocking positions by a lock lift assembly which is attached to a lower leg portion of the lock.

The first unlocking position is known as lockset which allows a knuckle of the coupler to swing from the closed position to the open position during, for example, an uncoupling operation from an attached railroad car. The second unlocking position is known as knuckle throw. In this position, the lock is raised above the lockset position to engage and rotate a knuckle thrower which in turn pivots the knuckle to the open position.

When the knuckle is open, a fulcrum portion of the lock rests on a tail portion of the knuckle and is supported thereby. As the knuckle swings from the open position to the closed position, the knuckle tail portion slides under the fulcrum lock portion. When the knuckle reaches the closed position the lock drops to the locking position. Knuckle closing occurs, for example during the coupling of two railroad cars, and upon completion, the cars are fixedly joined since the knuckle of each coupler is closed and locked.

During the closing swing of the knuckle, interaction between the knuckle tail and the leg portion of the coupler lock, however, may produce undesirable results. On occasion, the lock fails to drop into the locking position upon the knuckle being closed because the lock has been inadvertently placed in the lockset position by contact between the knuckle tail portion and the leg portion of the lock.

SUMMARY OF THE INVENTION

The knuckle tail portion of this invention includes an arcuate-shaped end wall having a substantially vertical middle part and radiused upper and lower parts each substantially equidistant from the pivot axis of the knuckle. The middle and upper parts terminate on one end at a vertical locking face angularly offset from the end wall. Extending outwardly from the locking face and forming part of the lower radiused part is a locking shelf. The locking shelf has a substantially horizontal top surface and a substantially flat angularly positioned bottom surface which extends in part below the lower radiused part of the end wall. The bottom radiused part extends beyond the locking face and joins the top and bottom surfaces of the locking shelf.

Adjacent to the locking face of the knuckle tail portion, the middle and the upper and lower radiused parts of the knuckle tail portion end wall have a selective contour. This selective contour provides a continuous clearance between the knuckle tail portion end wall and a leg portion of the lock.

To appreciate this new and useful knuckle tail portion contour of this invention, it must be understood that the lock of the coupler has an upper portion having a number of functional surfaces. As was mentioned, the lock upper portion includes the lock fulcrum which rests in part on the upper radiused part of the end wall of the knuckle tail portion when the knuckle is in the open position. The lock leg portion, which extends downwardly from the upper portion, includes a substantially vertical and angularly positioned front surface which connects with a knuckle shelf seat of the lock.

The contour of the knuckle tail portion of this invention maintains at least some clearance between the end wall of the knuckle tail portion and the leg portion of the lock throughout the closing swing of the knuckle. This clearance insures that the end wall of the tail portion does not contact the leg portion of the lock so as to move the leg portion rearwardly and inadvertently place the lock in the lockset position.

This improved coupler operation is achieved without modification of the lock and particularly to the leg portion of the lock where the cross-sectional area already has a reduced dimension.

Improved coupler performance is also achieved by minimum reduction to a thickness of the end wall of the knuckle tail portion which provides the necessary mechanical strength. Thus, existing cores used in fabrication of the knuckle as a casting need not be modified to compensate for a reduction in cross-sectional thickness.

Further, this improved knuckle tail portion contour requires only a minimum reduction in area of the locking face of the knuckle tail portion thus insuring an adequate contact surface for a locking face of the lock.

DESCRIPTION OF THE DRAWINGS

FIG. 3 is a top plan view of a standard AAR Type E coupler knuckle used in the coupler head of FIG. 1 and incorporates the improved knuckle tail portion of this invention.

FIG. 4 is a side elevation view of the knuckle of FIG. 3.

FIG. 5 is a detailed end elevation view of a locking face and lock shelf of the knuckle tail portion as seen generally along the line 4—4 of FIG. 3.

DESCRIPTION OF THE PREFERRED EMBODIMENT

Figure 1:
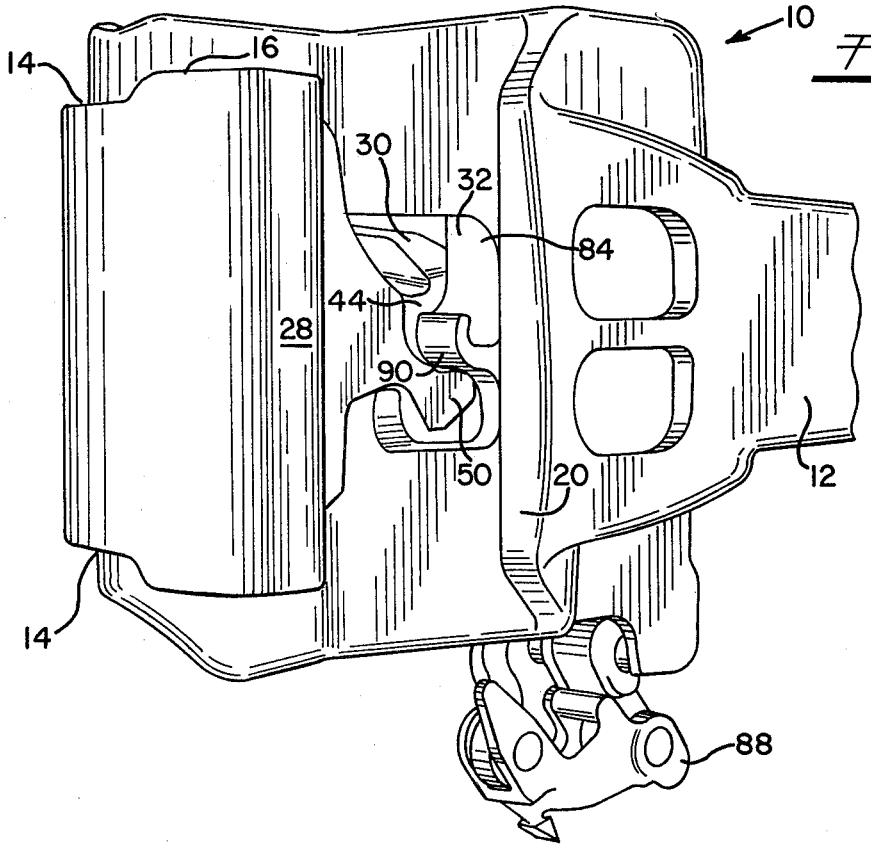
FIG. 1 is a perspective view of a coupler head of a railroad car coupler.

A head of an AAR (Association of American Railroads) Type E coupler is shown generally and designated 10. It should be understood that the coupler head 10 is formed at an outer end of a shank portion 12 (shown in part) of a coupler. The coupler is in turn connected to a body of a railroad car by a sill (not shown) and a yoke (not shown).

The coupler head 10 includes two vertically spaced lugs 14 which pivotally carry therebetween a knuckle 16 retained by a pivot pin (not shown). On the coupler head side opposite the pivot lugs 14 is a guard arm portion 20. As is well known, the pin apertures in the lugs 14 are slightly elongated allowing the knuckle 16 to move laterally as well as rotationally.

As best seen in FIG. 3, the knuckle 16 includes a circular pivot pin hole 26 for the pivot pin, a nose portion 28, and a rear tail portion 30 located on a side opposite the nose portion 28. The rear tail portion 30 of the knuckle 16 extends within the coupler head 10 where the tail portion 30 interacts with a coupler lock 32.

The tail portion 30 of the knuckle 16 is further defined by an end wall 34 divided into a substantially flat vertical middle part 36 and upper and lower radiused parts 38, 40. The end wall 34 of the tail portion 30 extends between a tail stop 42 and a locking face 44 and has an arcuated configuration as best seen in FIG. 3.

A longitudinal axis of the knuckle 16, as depicted by a line a—a in FIG. 3, intersects a center of the pivot pin hole 26 and a center point 46 located proximately midway between the tail stop 42 and the locking face 44 of the tail portion 30.

The end wall 34 between the locking face 44 and a point 48 located proximately midway between the center point 46 and the locking face 44 is maintained on a horizontal radius proximating 8 13/32 inches as depicted by an arrow R as seen in FIG. 3. The axis of the horizontal radius is the center of pivot pin hole 26. At the point 48, the radius is proximately tangential to an adjacent portion of the end wall 34. Using this radius dimension decreases a length of the locking face proximately $\frac{1}{8}$ inch over that of present AAR Type E coupler knuckles. The change in configuration can be seen in FIG. 3 where a broken line "L" represents the presently known configuration.

The tail portion 30 of the knuckle 16 further includes a lock shelf 50 which extends outwardly from the locking face 44 and is defined by a substantially horizontal top surface 52 and an inclined bottom surface 54 located under the top surface. The bottom surface 54 extends under the lower radiused part 40 of the knuckle tail end wall 34. The bottom surface 54 slopes downwardly toward the pivot pin hole 26 of the knuckle 16. The lower radiused part 40 extends beyond the locking face 44 of the knuckle tail portion 30 and joins the top surface 52 to the bottom surface 54 of the locking shelf 50. The bottom surface 54 terminates horizontally at a point below and proximately aligned with the point 46.

The end wall lower radiused part 40 is maintained on a vertical radius proximating $1\frac{3}{4}$ inches as depicted by an arrow R′ in FIGS. 4 and 5. A lower end 56 of the lower radiused part 40 intersects tangentially with the bottom surface 54 of the lock shelf 50. An upper end 58 of the lower radiused part 40 intersects the top horizontal surface 52 of the locking shelf 50 on an acute angle. Between the locking face 44 and the tail stop 48 the upper end 58 of the lower radiused part tangentially joins a bottom of the end wall middle part 36.

Figure 7:
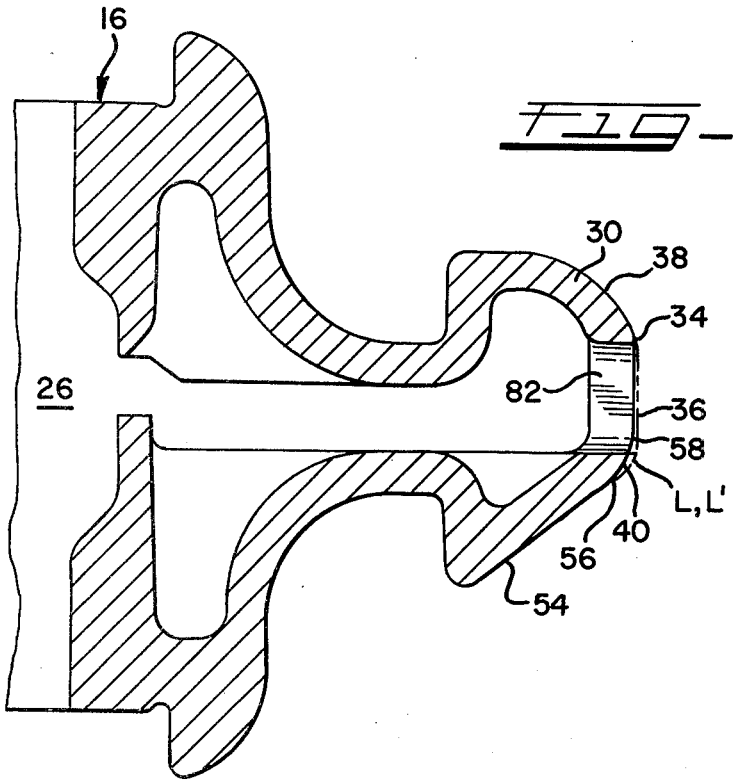
FIG. 7 is a partial cross-sectional elevation view of the knuckle as taken generally along the line 7—7 in FIG. 3.

The change in configuration by using $1\frac{3}{4}$ inch radiused lower part can be seen in FIGS. 4, 5 and 7 where a broken line "L′" represents the known configuration.

Figure 6:
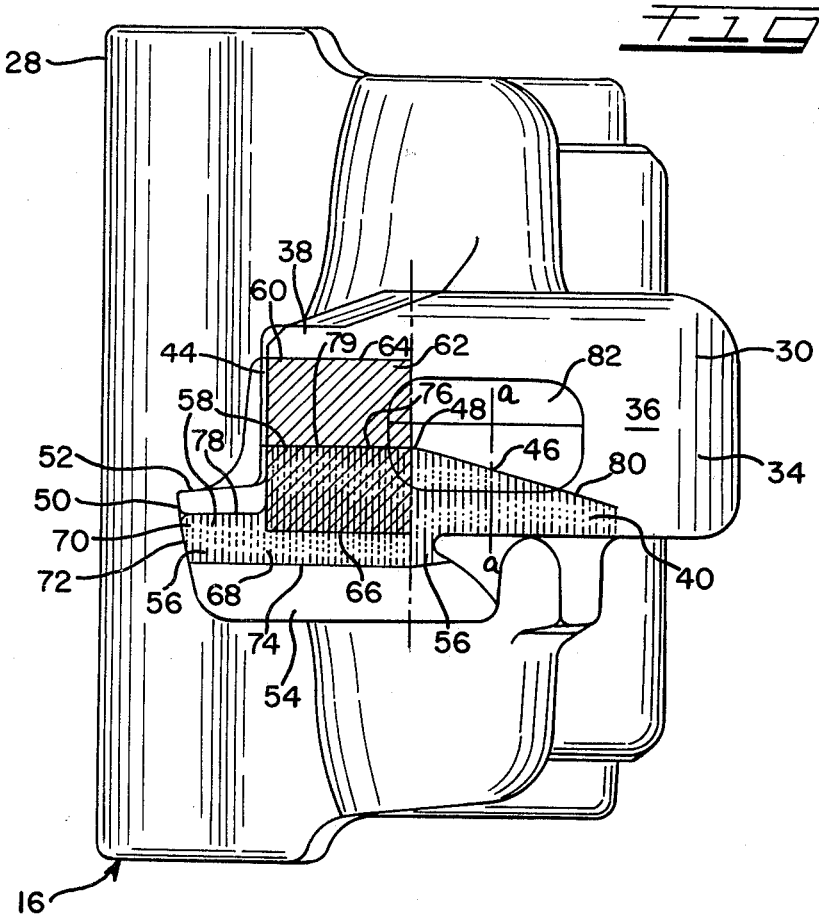
FIG. 6 is a rear elevation view of the knuckle of FIG. 3.

As seen in FIG. 6, the use of the 8 13/32 inch horizontal radius produces a first profile segment 60 having an affected area represented by angled lines 62. This first profile 60 lies horizontally between the locking face 44 and a vertical line passing through the point 48. Vertically the first profile segment lies between an upper edge 64 and a lower edge 66 located in the upper and lower radiused parts 38, 40 respectively.

Again referring to FIG. 6, the use of the $1\frac{3}{4}$ inch vertical radius produces a second profile segment 68 having an affected area represented by vertical lines 70. The second segment 68 extends horizontally from an outer end 72 of the lock shelf 50 to a point on an opposite side center point 46. Vertically the second segment 68 extends from a bottom edge 74 lying adjacent to a top of the bottom surface 54 and a top edge 76 having a first horizontal portion 78 which extends from the outer end 72 to the locking face 44 and a second horizontal portion 79 which extends between the locking face 44 and the point 48. At the point 48, the top edge 76 is further defined by a declining portion 80 which slopes downwardly and terminates on a side opposite the axis a—a.

A part of the top edge declining portion 80 is imaginary if the knuckle 16 is made as a casting since a core opening 82 is provided in the end wall 34.

Figure 2:
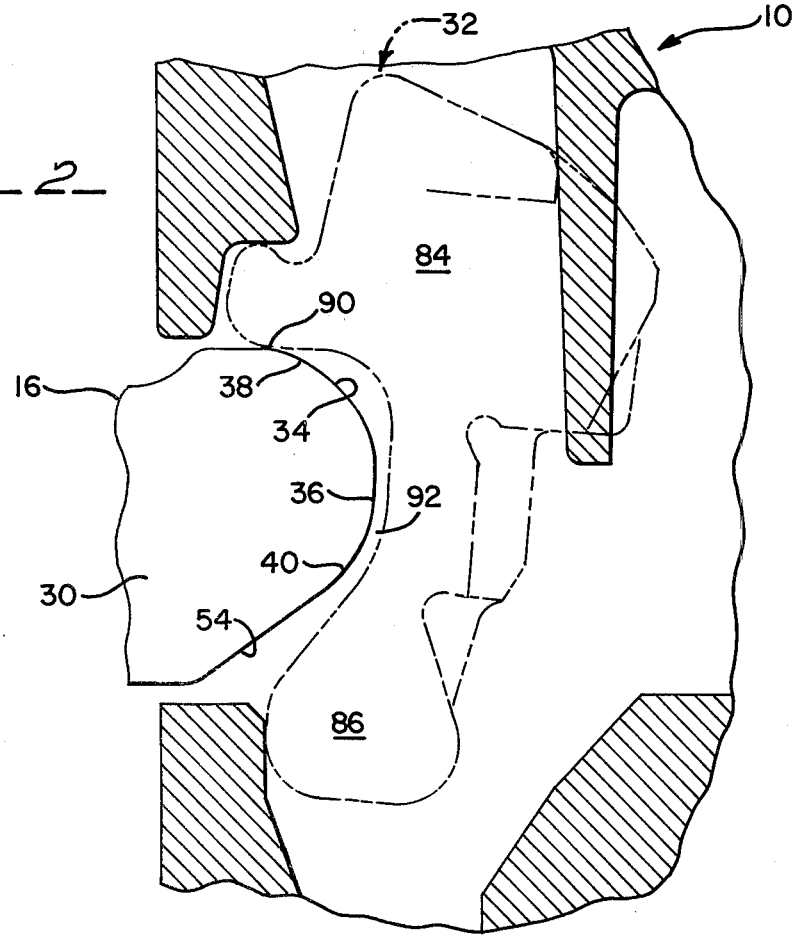
FIG. 2 is a partial cross-sectional view showing the relationship between the coupler head, a lock and a tail portion of a knuckle of the coupler.

As best seen in FIG. 2, the lock 32 includes an upper portion 84 and a lower leg portion 86. The lower leg portion may be connected to a lock lift assembly 88 whereby the lock 32 may be raised from a lower locking position as seen in FIG. 1 to a raised unlocking position as seen in FIG. 2. In the lower locking position, a knuckle shelf seat (not shown) of the upper portion 84 of the lock 32 rests on the lock shelf 50 of the knuckle tail portion 30. For the lock 32 to be in the lower locking position, the knuckle 16 must be closed, i.e. the knuckle nose 28 positioned adjacent to the guard arm portion 20 of the coupler head 10. Rotation of the knuckle 16 is prevented by interference between the locking face 44 of the knuckle tail portion 30 and a lock face (not shown) of the lock upper portion 84.

To allow the knuckle 16 to swing open, the lock 32 is raised so that the lock upper portion 84 lies above the knuckle tail portion 30. The knuckle 16 and its tail portion 30 then may swing past the lock leg portion 86.

The lock 32 may be raised to either of two positions. A first position, as is well known, is called lockset. With the lock 32 at lockset, the knuckle 16 may be swung open, for example, during an uncoupling operation from another railroad car attached to the coupler head 10. The force required to swing the knuckle 16 to the open position is provided by the knuckle of the other car as the couplers separate.

The second position to which the lock 32 may be raised is known as knuckle throw. As the lock 32 is raised above the lockset position, the lower leg portion 86 of the lock 32 engages the knuckle thrower (not shown) which cams the knuckle 16 to the open position.

During rotation of the knuckle 16 to the open position from lockset, the lock 32 is lifted from lockset and a fulcrum portion 90 of the lock 32 comes to rest on knuckle tail portion 30. Likewise, upon completion of the swing of the knuckle 16, as provided by knuckle throw, the lock 32 comes to rest on the knuckle tail portion 30 as noted. This is shown in FIG. 2.

To accomplish coupling, i.e. connecting the coupler head 10 with the coupler head of another car, the knuckle 16 first must be in a substantially open position. As the two couplers are brought together, the knuckle 16 is cammed toward the closed position by the other coupler head. During this rotational movement, the tail portion 30 of the knuckle 16 slides beneath the upper portion 84 of the lock 32. No contact between the knuckle tail portion end wall 34 and the lower leg portion 86 of the lock 32 occurs since there is a continuous clearance space 92 between such. This clearance space 92 is provided by the tail portion end wall 34 formed on the horizontal and vertical radii noted earlier.

By insuring that the space 92 always exists, there can be no contact between the end wall 34 of the knuckle tail portion 30 which could inadvertently return the lock 32 to lockset. In lockset, the lock 32 would not drop to the lower locking position once the locking face 44 on the knuckle tail portion 30 had swung past the lock 32 and support of the lock 32 is terminated.

While various modifications may be suggested by those versed in the art, it should be understood that I wish to embody within the scope of the patent warranted hereon, all such modifications as reasonably and properly come within the scope of my contribution to the art.

What is claimed is:

1. In an E-type railroad car coupler having a coupler head rotatively carrying a knuckle and a lock positioned in a vertical lock chamber formed in said coupler head, said knuckle swingable about a pivot center between a closed and locked position and an open and unlocked position as regulated by a vertical position of said lock in said lock chamber, said lock position allowing a selective interaction between a tail portion of said knuckle and said lock, an improvement of said knuckle tail portion further comprising, an arcuated end wall defined by a substantially vertical middle part joined by a lower radiused part and an upper radiused part, said end wall extending horizontally between a tail stop and a locking face of said knuckle tail portion, a locking shelf projecting outwardly from said locking face with said lower radiused part extending beyond said locking face to an outer end of said shelf, said middle part and said upper and lower radiused parts having a selective contour to form a continuous space between said knuckle tail portion end wall and a leg portion of said lock upon said lock being in a raised unlocking position, said knuckle tail portion further defined by said end wall middle part and upper and lower radiused parts formed on a selective horizontal radius as measured from a pivot axis of said knuckle, said horizontal radius having one end terminating at said locking face of said knuckle tail portion and an opposite end intersecting substantially tangential to an adjacent portion of said end wall with said opposite end proximately aligning with a point located one-fourth of a distance from said locking face to said tail stop, and said end wall lower radiused part further formed on a selective vertical radius having a bottom end tangentially joining a bottom inclined surface of said tail portion and a top end joining a top surface of said locking shelf and a bottom of said end wall middle part between said locking face and said point and extending toward said knuckle tail stop and terminating beyond a midpoint of said knuckle tail portion end wall, wherein contact between said knuckle tail portion end wall and said lock leg portion is prohibited by said space as said knuckle swings from said open position to said closed position.

2. An improvement of a railroad car coupler knuckle tail portion as defined by claim 1 and further characterized by, said horizontal radius having a dimension proximating 8 $\frac{3}{8}$ inches, and said vertical radius having a dimension proximating $1\frac{3}{4}$ inches.

* * * * *